US010531184B2

(12) United States Patent
Voishvillo

(10) Patent No.: US 10,531,184 B2
(45) Date of Patent: Jan. 7, 2020

(54) SHALLOW PROFILE COMPRESSION DRIVER

(71) Applicant: Harman International Industries, Incorporated, Stamford, CT (US)

(72) Inventor: Alexander Voishvillo, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/297,935

(22) Filed: Mar. 11, 2019

(65) Prior Publication Data

US 2019/0208313 A1 Jul. 4, 2019

Related U.S. Application Data

(63) Continuation of application No. 14/878,803, filed on Oct. 8, 2015, now Pat. No. 10,271,131.

(60) Provisional application No. 62/061,380, filed on Oct. 8, 2014.

(51) Int. Cl.
*H04R 1/30* (2006.01)
*H04R 9/06* (2006.01)

(52) U.S. Cl.
CPC ..... *H04R 1/30* (2013.01); *H04R 9/06* (2013.01); *H04R 2201/34* (2013.01); *H04R 2400/13* (2013.01)

(58) Field of Classification Search
CPC ..... G10K 11/025; H04R 1/30
See application file for complete search history.

(56) References Cited

U.S. PATENT DOCUMENTS

| | | | |
|---|---|---|---|
| 4,325,456 | A | 4/1982 | Ureda |
| 5,537,481 | A | 7/1996 | Voishvillo et al. |
| 5,878,148 | A | 3/1999 | Alexandrov |
| 6,320,970 | B1 | 11/2001 | Czerwinski et al. |
| 7,039,211 | B2 | 5/2006 | Werner |
| 8,036,408 | B2 | 10/2011 | Voishvillo |
| 8,077,897 | B2 | 12/2011 | Voishvillo |
| 8,280,091 | B2 | 10/2012 | Voishvillo |
| 2004/0156519 | A1 | 8/2004 | Geddes |
| 2007/0147647 | A1 | 6/2007 | Voishvillo |
| 2009/0310809 | A1 | 12/2009 | Voishvillo |

(Continued)

FOREIGN PATENT DOCUMENTS

| | | | |
|---|---|---|---|
| DE | 102015209837 | A1 | 12/2015 |
| EP | 2640089 | A2 | 9/2013 |

OTHER PUBLICATIONS

International Search Report and Written Opinion for Application No. PCT/US2017/042715, dated Sep. 11, 2017, 13 pages.

*Primary Examiner* — Matthew A Eason
*Assistant Examiner* — Taunya McCarty
(74) *Attorney, Agent, or Firm* — Brooks Kushman P.C.

(57) ABSTRACT

A compression driver includes a phasing plug including a base portion having a first side and an opposed second side, the first side including a central hub portion extending outwardly from the first side, the base portion including one or more apertures that extend therethrough from the first side to the second side. A diaphragm is disposed adjacent the phasing plug second side, and a compression chamber defined between the diaphragm and the phasing plug. In one embodiment, a front plate is attached to the phasing plug first side, the front plate having a central aperture generally aligned with the hub portion and base portion apertures. A horn may be attached to the front plate or directly to the phasing plug first side.

12 Claims, 4 Drawing Sheets

(56) References Cited

U.S. PATENT DOCUMENTS

| | | | |
|---|---|---|---|
| 2011/0085692 | A1 | 4/2011 | Voishvillo |
| 2011/0168480 | A1 | 7/2011 | Sterling et al. |
| 2016/0105744 | A1 | 4/2016 | Voishvillo |

SHALLOW PROFILE COMPRESSION DRIVER

CROSS-REFERENCE TO RELATED APPLICATIONS

This application is a continuation of U.S. application Ser. No. 14/878,803 filed Oct. 8, 2015, which, in turn, claims the benefit of U.S. provisional application Ser. No. 62/061,380 filed Oct. 8, 2014, the disclosures of which are hereby incorporated in their entirety by reference herein.

TECHNICAL FIELD

Embodiments relate to a shallow profile compression driver.

BACKGROUND

There are two major types of compression drivers, the first utilizing a dome diaphragm, and the other using an annular flexural diaphragm. The majority of modern annular diaphragms are made of polymer films. The advantage of annular diaphragms is the smaller radial dimensions of the moving part of the diaphragm compared to the dome diaphragms having the same diameter of the moving voice coil. The small radial clamping dimension of the annular diaphragm shifts the mechanical breakup resonances of the diaphragm to higher frequencies where they can be better mechanically damped, since the damping is more efficient at high frequencies in polymer films. Better damping is indicative of the smoother frequency response and lower nonlinear distortion generated by diaphragms' breakups at high frequency.

In a compression driver, the diaphragm is loaded by a compression chamber, which is a thin layer of air separating the diaphragm from a phasing plug. The small radial dimension of the annular diaphragm corresponds to the small radial dimensions of the matching compression chamber, which shifts undesirable air resonances (cross-modes) in the chamber to higher frequencies, sometimes above the audio range in small-format compression drivers. Since the annular diaphragm has two clamping perimeters, inside and outside of the moving part of the diaphragm, the annular diaphragm has a better dynamic stability and it is less prone to the rocking modes compared to a dome diaphragm that has only external clamping.

The volume of air entrapped in the compression chamber is characterized by an acoustical compliance which is proportional to the volume of compression chamber. Acoustical compliance acts as a low-pass filter of the first order and it mitigates the high frequency signal. Therefore, it is desirable to keep the volume of the compression chamber (which depends on the distance between the diaphragm and the phasing plug) low. However, excessively close positioning of the diaphragm to the phasing plug generates distortion due to the nonlinear compression of air in the compression chamber, and may cause rub and buzz or even collision of the diaphragm with the phasing plug. As such, positioning of the diaphragm with respect to the phasing plug is always a compromise.

The area of the entrance to the phasing plug is significantly smaller than the area of the diaphragm. The air paths of the phasing plug are essentially the beginning of the horn which is attached to the compression driver to control directivity (i.e., coverage of sound pressure over a particular listening area) and to increase reproduced sound pressure level over a certain frequency range. The overall acoustical cross-sectional area of the air paths in the phasing plug (there are typically multiple paths) and then of the horn must gradually increase to provide a smooth transition of sound waves to the mouth of the horn. The narrowing of the area would produce undesirable reflections of sound waves back to the entrance of the horn which would interfere with the outgoing sound waves and would produce severe ripples on the sound pressure frequency response.

Compression drivers usually have standard circular exit diameters, typically 1" for small-format compression drivers, 1.5", and 2" for larger format compression drivers. Compression drivers which use an annular diaphragm have an adapter assembly that connects the driver to the horn, where the adapter assembly includes a phasing plug and an outer housing. The phasing plug may include a hub portion or central bullet having an outer surface, and the cylindrical, conical or curved outer housing includes an inner surface. The outer surface and inner surface cooperatively define a waveguide for the propagation of sound waves through the adapter assembly. The output end of the housing may be coupled to the input end of the horn or waveguide by any suitable means, such as via threaded surfaces, with the intention that the waveguide fluidly communicates with the interior of the horn.

SUMMARY

In one embodiment, a compression driver includes a phasing plug including a base portion having a first side and an opposed second side, the first side including a central hub portion extending outwardly from the first side, the base portion including one or more apertures that extend therethrough from the first side to the second side. A diaphragm is disposed adjacent the phasing plug second side, and a compression chamber is defined between the diaphragm and the phasing plug. A front plate is attached to the phasing plug first side, the front plate having a central aperture generally aligned with the hub portion and the base portion apertures, the central aperture forming an exit of the compression driver.

In another embodiment, a horn driver includes a phasing plug including a base portion having a first side and an opposed second side, the first side including a central hub portion extending outwardly from the first side, the base portion including one or more apertures that extend therethrough from the first side to the second side. A diaphragm is disposed adjacent the phasing plug second side, and a compression chamber defined between the diaphragm and the phasing plug. A front plate is attached to the phasing plug first side, the front plate having a central aperture generally aligned with the hub portion and base portion apertures. A horn is attached to the front plate, the horn having an inlet and an outlet, where the horn inlet is generally aligned with the central aperture.

In another embodiment, a horn driver includes a phasing plug including a base portion having a first side and an opposed second side, the first side including a central hub portion extending above the first side, the base portion having apertures that extend therethrough from the first side to the second side. A diaphragm is disposed adjacent the phasing plug second side, and a compression chamber is defined between the diaphragm and the phasing plug. A horn is attached to the phasing plug first side, the horn having an inlet and an outlet, wherein the horn inlet is generally aligned with the hub portion and the base portion apertures.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
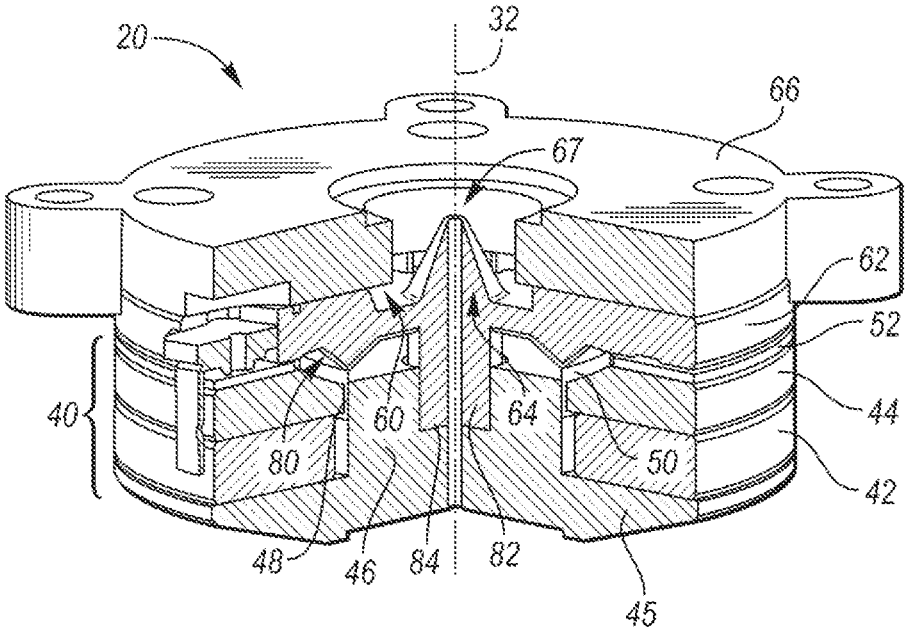
FIG. 1 is a perspective, cross-sectional view of a compression driver according to an embodiment.
Figure 2:
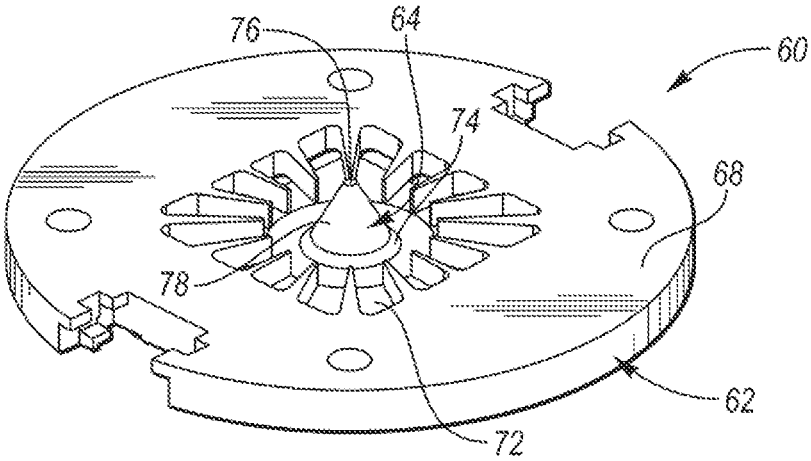
FIG. 2 is a perspective view of a first side of a phasing plug arranged to face the front plate according to an embodiment.

The adapter housing that is used in typical compression drivers equipped with an annular diaphragm is essentially a redundant element, as it only extends the air path to the horn and, due to the requirement for expansion of the cross-section, is connected to the horn when its cross-section is already comparatively large. Accordingly, embodiments of a shallow profile compression driver disclosed herein essentially discard the adapter housing, and horn begins with the area of the entrances to the phasing plug. The area of the compression driver's exit is slightly larger than the area of the entrances to the phasing plug, as shown in FIG. 1. This configuration provides gradual expansion of the air path's cross-sectional area from the entrance to the phasing plug to the entrance of the horn or waveguide. The compression driver therefore has a much shallower profile than previous designs.

With reference first to FIGS. 1-8, a horn driver 10 including a compression driver 20 and attached horn 30 are illustrated. The compression driver 20 and horn 30 are generally disposed about a central axis 32. As shown in FIGS. 5-8, the horn 30 may include one or more walls 34 that enclose an interior of the horn 30. The horn walls 34 may be flared or tapered outwardly from the central axis 32 to provide an expanding cross-sectional area through which sound waves propagate. The horn walls 34 form an inlet 36, or throat, and an outlet 38, also referred to as the horn mouth. The horn 30 also typically includes a flange 39 adjacent the inlet 36, wherein the flange 39 may have a generally circular plate configuration as shown, or any other suitable construction for mounting to the compression driver 20 as described further below.

Figure 4:
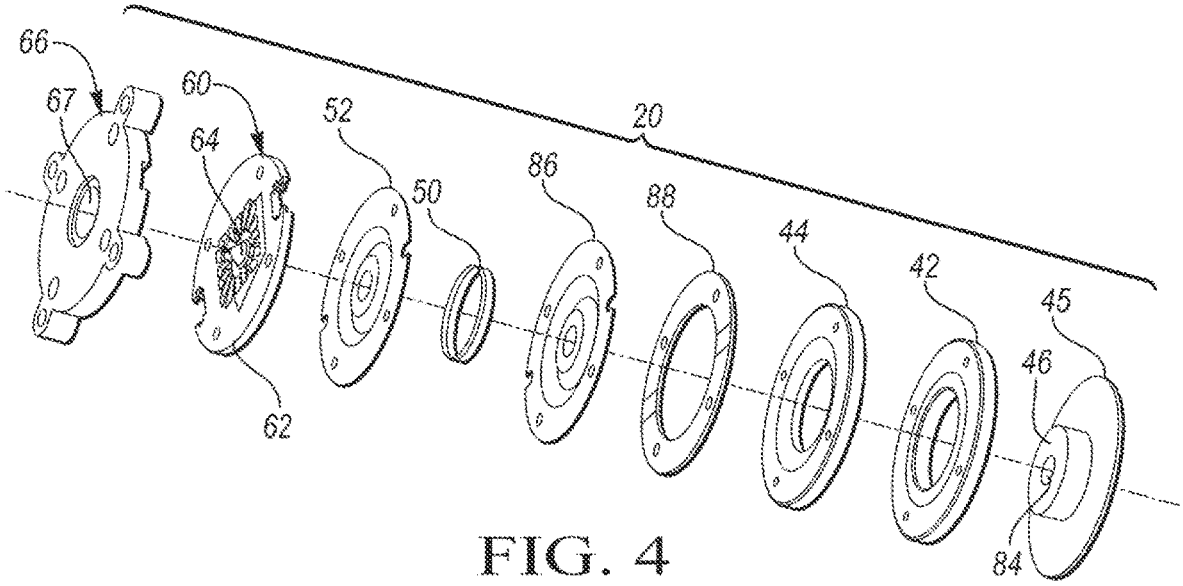
FIG. 4 is an exploded view of the compression driver according to an embodiment.

As shown in FIG. 1 and the exploded view of FIG. 4, the compression driver 20 may includes a magnet assembly 40 which may comprise an annular permanent magnet 42 disposed between an annular top plate 44 and a back plate 45 that includes a centrally disposed cylindrical or annular pole piece 46. The magnet assembly 40 provides a permanent magnetic field in the gap 48 between the pole piece 46 and an inside surface of the annular top plate 44 for electrodynamic coupling with a voice coil 50. The voice coil 50 is disposed in the magnetic gap 48 and produces the movement of the flexible portion of a diaphragm 52. In the embodiments depicted herein, the diaphragm 52 is configured as an annular ring that is disposed coaxially with the central axis 32 above the magnet assembly 40. The diaphragm 52 may include a profiled section such as a V-shaped section. In other implementations, the diaphragm 52 may have other suitable configurations.

With reference to FIGS. 1-4, the compression driver 20 also includes a phasing plug 60 having a base portion 62 and a central or hub portion 64 extending outwardly from the base portion 62, both of which are coaxially disposed about the central axis 32. The hub portion 64 may also be referred to as a bullet. The hub portion 64 may be integrally formed with the base portion 62 or may be attached to the base portion 62 by any suitable means. The base portion 62 of the phasing plug 60 may be generally circular or may have any other suitable geometry. An annular front plate 66 is attached to the phasing plug 60, wherein a central aperture 67 of the front plate 66 serves as a small diameter exit of the compression driver 20. The aperture 67 may be circular as shown, or alternatively may have another shape, such as elliptical or rectangular. In one embodiment, the central aperture 67 is configured to substantially match the size and shape configuration of the horn inlet 36.

The base portion 62 includes a first side 68 (FIG. 2) generally facing the front plate 66, and an opposing second side 70 (FIG. 3) generally facing the diaphragm 52. The base portion 62 includes one or more apertures 72 that extend through the base portion 62 from the first side 68 to the second side 70 through which sound energy may travel. The apertures 72 may be configured as radial slots emanating from the hub portion 64 as depicted herein, or may have any other suitable shape and configuration. As assembled, the central aperture 67 of the front plate 66 is generally aligned with the hub portion 64 and the base portion apertures 72.

The hub portion 64 has a first end 74 disposed proximate to the base portion 62 and a second end 76 disposed at a distance from the base portion 62 along the central axis 32. An outer surface 78 of the hub portion 64 may taper in the direction along the central axis 32 from the first end 74 to the second end 76, such that the radius of the cross-section of the hub portion 64 relative to the central axis 32 decreases in this direction. In some implementations, the outer surface 78 of the hub portion 64 may be characterized as being shaped as a "candy kiss." In one embodiment, the hub portion 64 may have a relatively small height above the first side 68 compared to a thickness of the base portion 62 such as, but not limited to, a height between one and two times the thickness of the base portion 62. In the embodiments depicted, the height of the hub portion 64 does not extend above a height of the front plate 66 or the horn flange 39.

A compression chamber 80 is defined in a space between the diaphragm 52 and the second side 70 of the phasing plug base portion 62. In practice, the height of the compression chamber 80 may be quite small (e.g., approximately 0.5 mm or less) such that the volume of the compression chamber 80 is also small.

Figure 3:
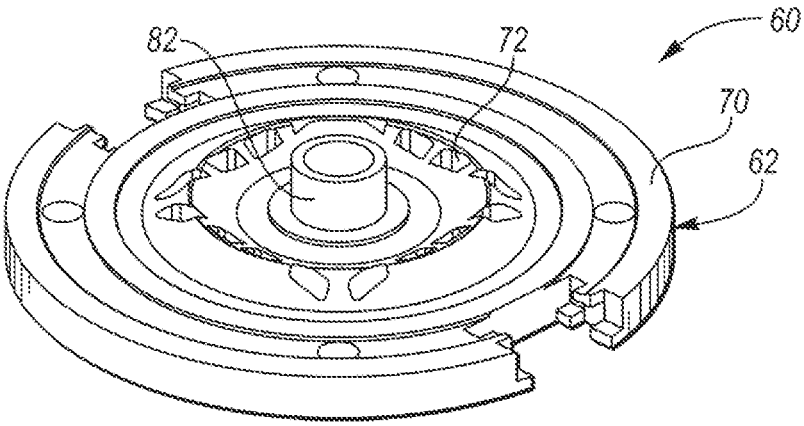
FIG. 3 is a perspective view of a second side of the phasing plug arranged to face the diaphragm.

As best shown in FIG. 3, the phasing plug 60 may include a mounting member 82 on the second side 70 that depends downwardly from the base portion 62. The mounting member 82 may have any configuration suitable for coupling the phasing plug 60 to the rear section of the compression driver 20. In one embodiment, the mounting member 82 is provided in the form of a cylinder that is arranged to be press fit into a central bore 84 formed in the pole piece 46. As best shown in FIG. 4, the compression driver 20 may also include additional components, such as a glue ring 86 and a spacer ring 88 interposed between the diaphragm 52 and the top plate 44 of the magnet assembly 40.

Figure 5:
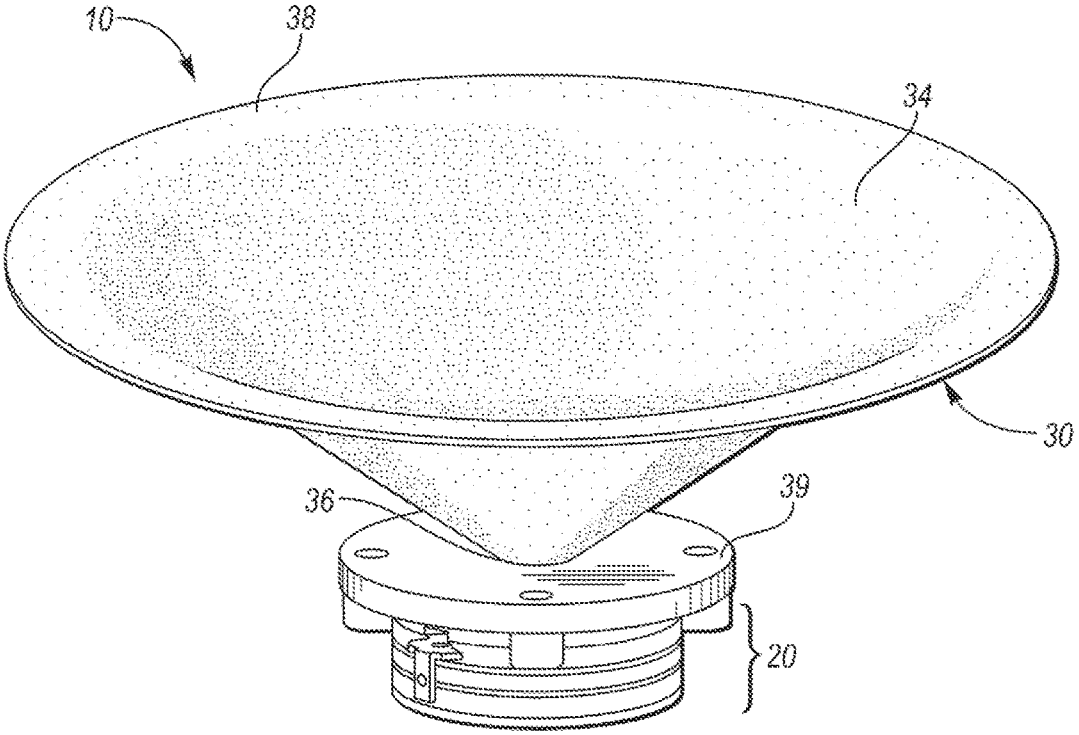
FIG. 5 is a perspective view of a compression driver with an attached horn according to an embodiment.
Figure 6:
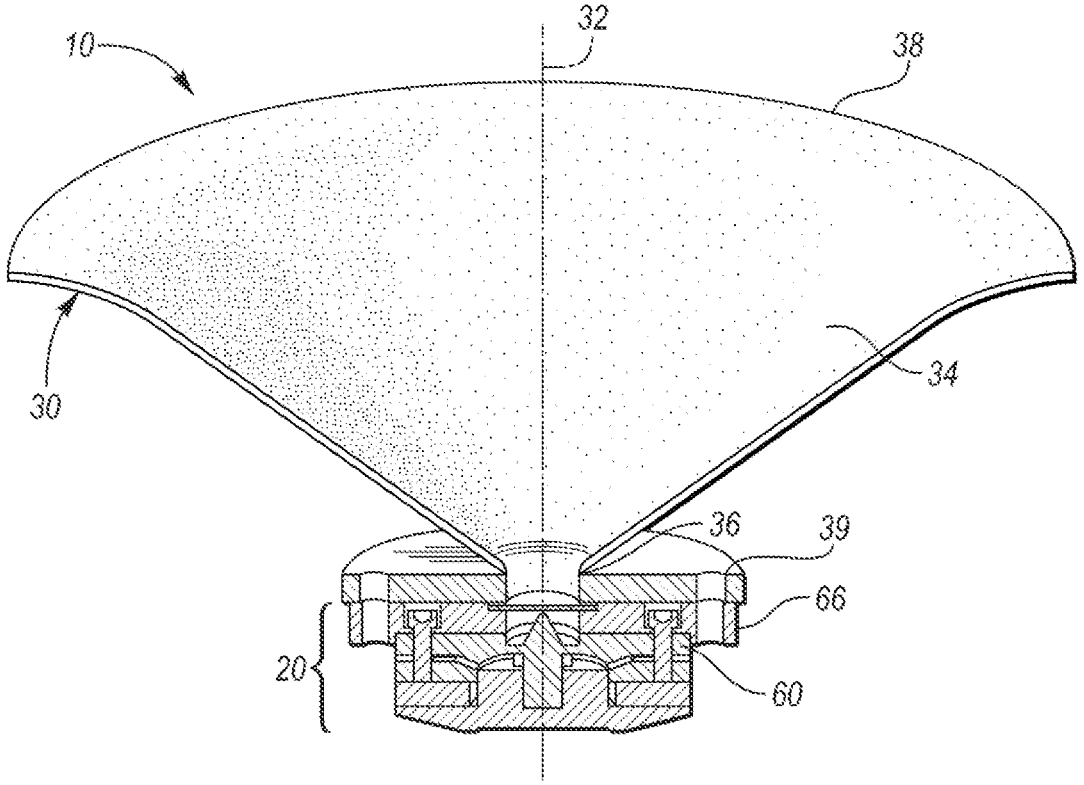
FIG. 6 is a cross-sectional view of the compression driver and attached horn of FIG. 5.
Figure 7:
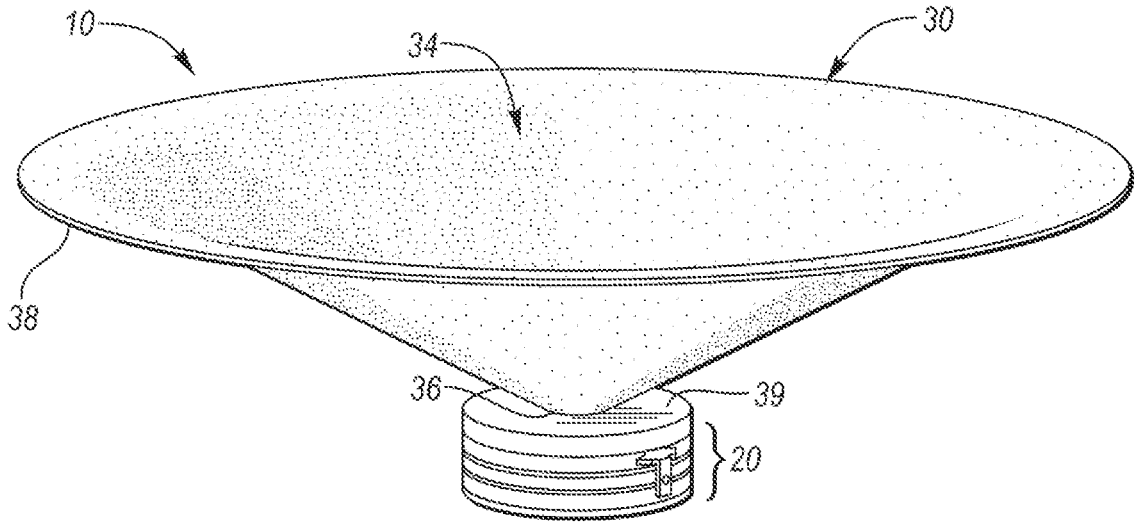
FIG. 7 is a perspective view of a compression driver with an attached horn according to another embodiment.
Figure 8:
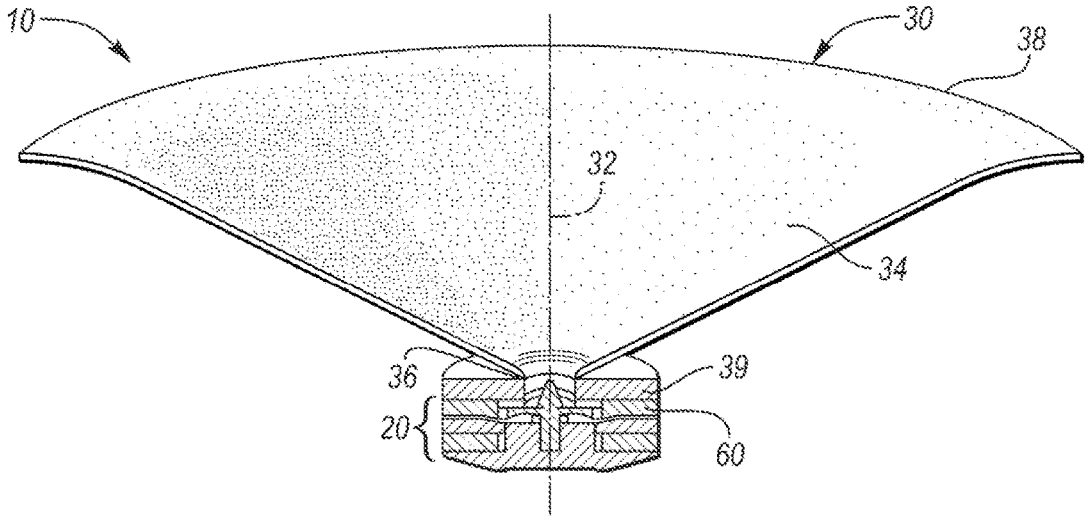
FIG. 8 is a cross-sectional view of the compression driver and attached horn of FIG. 7.

An illustration of the compression driver 20 with an attached horn 30 is shown in FIGS. 5 and 6. In this configuration, the compression driver 20 may be attached to the horn 30, for example, by bolts that connect the front plate 66 to the horn flange 39, such that the horn inlet 36 is generally aligned with the central aperture 67. In an alternate configuration shown in FIGS. 7 and 8, the front plate is omitted and the flange 39 of the horn 30 is attached directly to the phasing plug 60, for example, by adhesive, and generally aligned with the phasing plug apertures 72. This latter configuration may be feasible for low-cost disposable horn drivers. Alternatively, the phasing plug 60 may be provided with mounting holes and then the compression driver 20 without the front plate may be bolted to the horn flange 39.

With reference to FIG. 1, the actuation of the diaphragm 52 generates high sound-pressure acoustical signals within the compression chamber 80, and the signals travel axially as sound waves through the base portion 62 of the phasing plug 60 via the apertures 72 that provide passages from the second side 70 to the first side 68. The acoustical signals then travel towards the center of the phasing plug 60, immediately adjacent to the front plate aperture 67. From the apertures 72, the sound waves enter and radiate through the attached horn inlet 36, through the interior of the horn, and propagate into the ambient environment from the horn mouth 38. In this configuration, the acoustical path becomes shortest possible to the horn inlet 36, starting with a smaller diameter and providing directivity control to higher frequencies. The disclosed embodiments are significantly shallower than the traditional design of compression drivers which utilize an annular diaphragm. This may be important in particular configurations where the shallowness of the driver is required.

Figure 9:
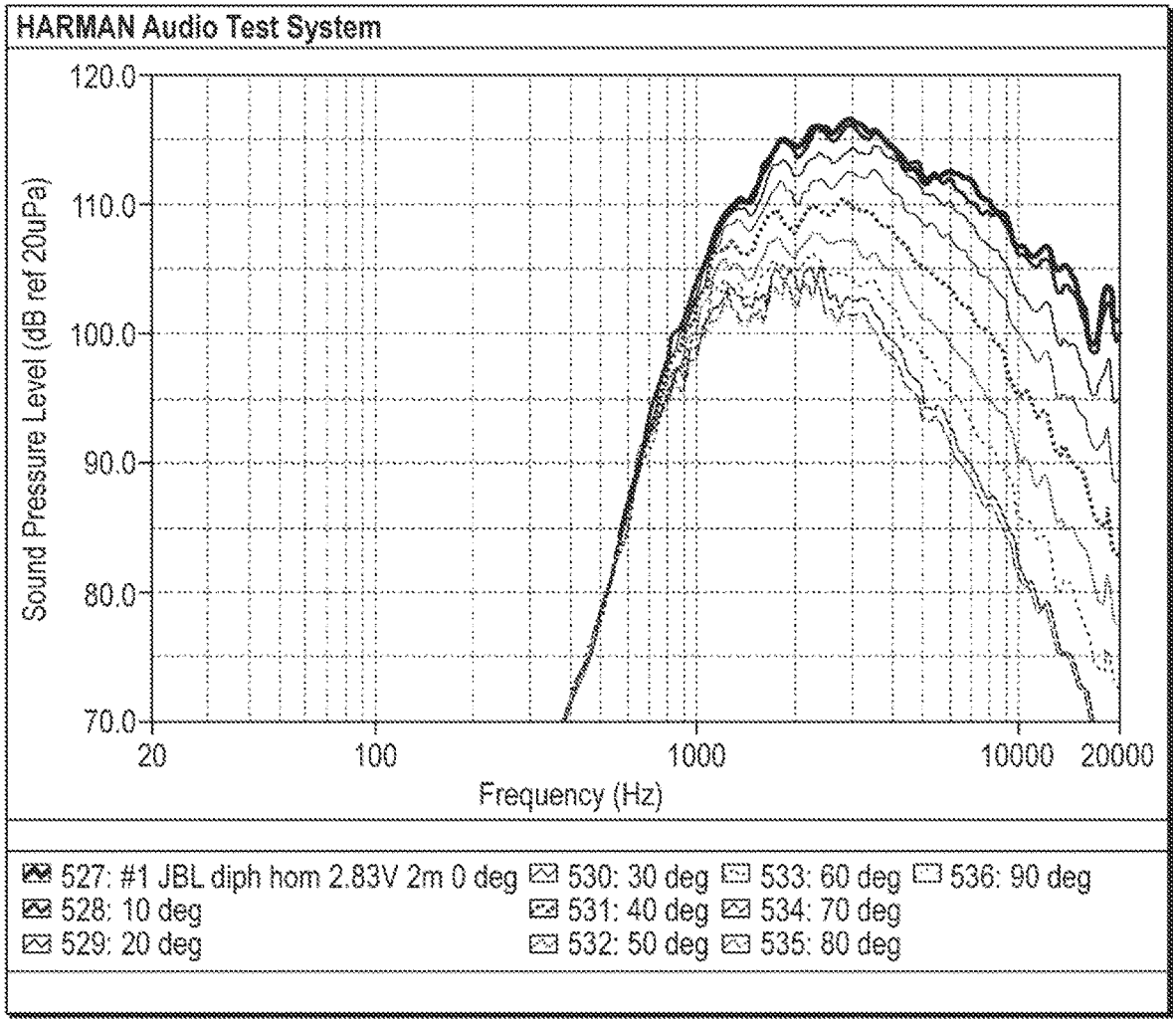
FIG. 9 is a graph of the frequency responses of the compression driver at different angles loaded by a Holland-Newell axisymmetric horn.

A graph depicting the results of the measurement of frequency response at different angles to the axis of the driver is shown in FIG. 9. The graph shows frequency responses of the new driver loaded by the so-called Holland-Newell axisymmetric horn (see K. Holland, "A Study of the Physical Properties of Loudspeaker Horns and Their Relationship to Perceived Sound Quality", Ph.D. thesis, University of Southampton, 1992). The space resolution is 10 degrees from on-axis to 90 degrees angles. The response is characterized by very high smoothness and extended frequency range. The bell-shaped form of the sound pressure response is normal, and it is explained by the nature of the radiation from the horn. The shapes of the frequency responses measured at different angles are similar in that while they decrease in level, the balance between the low and high frequency signals is essentially the same. In a design with a larger output of the compression driver, the relative high-frequency level would start decreasing much faster.

Advantages of the disclosed embodiments include, but are not limited to: 1) the lack of a cylindrical long front adapter that increases the output diameter and makes the high frequency response highly dependent on the angle to the axis; 2) the smaller output diameter improves radiation at high frequency and provides wider directivity response; 3) the design is shallow which is an advantage in certain applications; 4) alternative configuration (FIGS. 7 and 8) may omit the front plate making the driver even more shallow; 5) a smooth, easily equalizable frequency response of the driver; and 6) an extended frequency range of the driver.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A horn driver, comprising:

a phasing plug including a base portion having a first side and an opposed second side, the first side including a central hub portion extending outwardly from the first side, the base portion having apertures that extend therethrough from the first side to the second side;

a diaphragm disposed adjacent the phasing plug second side;

a compression chamber defined between the diaphragm and the phasing plug; and a horn directly attached to the phasing plug first side, the horn having an inlet and an outlet, the horn including a flange adjacent the horn inlet for mounting to the phasing plug first side, the flange extending at least partially over the apertures of the phasing plug for directing acoustical signals traveling from the apertures to the horn inlet.

2. The horn driver of claim 1, wherein a height of the hub portion does not extend above a height of the flange.

3. The horn driver of claim 1, wherein the diaphragm is configured as an annular ring.

4. The horn driver of claim 1, further comprising a magnet assembly disposed beneath the diaphragm, the magnet assembly including an annular permanent magnet disposed between an annular top plate and a back plate having a centrally disposed pole piece, the magnet assembly providing a magnetic field in a magnetic gap located between the pole piece and an inside surface of the top plate.

5. The horn driver of claim 4, wherein the phasing plug second side includes a mounting member that depends downwardly therefrom for mounting to the pole piece.

6. The horn driver of claim 1, wherein an outer surface of the hub portion tapers from a first end proximate the base portion to a second end disposed at a distance from the base portion.

7. A horn driver, comprising:

a phasing plug including a base portion having a first side and an opposed second side, the first side including a central hub portion extending outwardly from the first side, the base portion having an apertured region including apertures that extend therethrough from the first side to the second side;

a diaphragm disposed adjacent the phasing plug second side;

a compression chamber defined between the diaphragm and the phasing plug; and a horn directly attached to the phasing plug first side, the horn having an inlet and an outlet, the horn including a flange adjacent the horn inlet for mounting to the phasing plug first side, wherein a diameter of the horn inlet is smaller than a diameter of the apertured region.

8. The horn driver of claim 7, wherein a height of the hub portion does not extend above a height of the flange.

9. The horn driver of claim 7, wherein the diaphragm is configured as an annular ring.

10. The horn driver of claim 7, further comprising a magnet assembly disposed beneath the diaphragm, the magnet assembly including an annular permanent magnet disposed between an annular top plate and a back plate having a centrally disposed pole piece, the magnet assembly providing a magnetic field in a magnetic gap located between the pole piece and an inside surface of the top plate.

11. The horn driver of claim 10, wherein the phasing plug second side includes a mounting member that depends downwardly therefrom for mounting to the pole piece.

12. The horn driver of claim 7, wherein an outer surface of the hub portion tapers from a first end proximate the base portion to a second end disposed at a distance from the base portion.

* * * * *